United States Patent [19]

Katz et al.

[11] Patent Number: 5,037,004

[45] Date of Patent: Aug. 6, 1991

[54] ICE DISPENSER FOR THE AUTOMATIC ICE MAKER OF A REFRIGERATOR

[75] Inventors: Robert Katz; Virgil R. Thompson, both of Galesburg, Ill.

[73] Assignee: Maytag Corporation, Newton, Iowa

[21] Appl. No.: 551,850

[22] Filed: Jul. 12, 1990

[51] Int. Cl.[5] ..... F25C 5/00; G01F 11/00

[52] U.S. Cl. ..... 222/146.6; 222/240; 222/241; 222/413; 62/344

[58] Field of Search ..... 222/240, 241, 146.6, 222/413; 62/344

[56] References Cited

U.S. PATENT DOCUMENTS

| | | | |
|---|---|---|---|
| 2,073,792 | 3/1937 | Gray et al. | 222/240 |
| 3,422,994 | 1/1969 | Alvarez | 222/240 |
| 3,427,244 | 4/1969 | Alvarez et al. | 222/240 |
| 3,537,618 | 11/1970 | Alvarez et al. | 222/240 |
| 3,570,720 | 3/1971 | Curry, III | 222/240 |
| 3,602,406 | 8/1971 | Jacobus et al. | 222/413 |
| 3,722,755 | 3/1973 | Nakashima | 222/413 X |
| 3,798,923 | 3/1974 | Pink et al. | 62/344 |
| 3,858,765 | 1/1975 | Landers | 222/413 |
| 3,874,559 | 4/1975 | Pink | 222/146.6 |
| 3,902,331 | 9/1975 | True, Jr. et al. | 222/413 |
| 4,084,725 | 4/1978 | Buchser | 62/344 |
| 4,176,527 | 12/1979 | Linstromberg et al. | 222/240 |
| 4,512,502 | 4/1985 | Landers | 222/413 |
| 4,619,380 | 10/1986 | Brooks | 222/413 |
| 4,627,556 | 12/1986 | Brooks | 222/240 |
| 4,641,763 | 2/1987 | Landers et al. | 222/146.6 X |
| 4,694,661 | 9/1987 | Landers | 222/413 |

FOREIGN PATENT DOCUMENTS

| | | | |
|---|---|---|---|
| 571458 | 1/1958 | Italy | 222/413 |
| 4078 | of 1886 | United Kingdom | 222/413 |

*Primary Examiner*—Michael S. Huppert
*Assistant Examiner*—Anthoula Pomrening
*Attorney, Agent, or Firm*—Bacon & Thomas

[57] ABSTRACT

Ice cubes manufactured by the automatic ice maker of a household refrigerator are collected in a storage bin and conveyed towards the front of the bin and metered through an outlet opening at a constant rate by a longitudinal conveyor rotatably mounted between the front and back walls of the bin, and defined by spaced front and back helical sections of different pitches which convey the cubes forwardly at different rates and a propeller positioned on the conveyor forwardly of the front helical section at the outlet opening for breaking up frozen ice clusters and metering the cubes through the opening and past an upwardly angled ramp carried by an ice dam housing.

16 Claims, 4 Drawing Sheets

ICE DISPENSER FOR THE AUTOMATIC ICE MAKER OF A REFRIGERATOR

BACKGROUND OF THE INVENTION

1. Field of the Invention

The present invention generally involves the field of technology pertaining to mechanisms for dispensing materials from a storage area. More specifically, the invention relates to an improved apparatus for dispensing ice cubes collected in the storage bin of an automatic ice maker disposed in the freezer compartment of a household refrigerator.

2. Description of the Prior Art

It is known to provide a conventional household refrigerator with an ice dispenser which collects and dispenses ice cubes manufactured by an automatic ice maker to an exterior service area of the freezer door. This affords a convenience for the user since it is only necessary to insert a receptacle, such as a glass or cup, in the service area to engage an actuator which activates the dispenser motor, thereby avoiding the necessity of having to open the freezer door which causes loss of cold air and influx of warm ambient air.

Known ice dispensers are usually in the form of a helical auger which is rotatably supported within the ice storage bin and rotated by a motor through an appropriate gear reduction assembly. Rotation of the auger advances the ice cubes forwardly to the front of the bin, outwardly of the bin through an outlet opening and downwardly through a delivery chute into the receptacle positioned within the service area of the freezer or refrigerator door.

Several auger structures have been proposed for ice dispensers. For example, a helical wire auger formed from a length of solid rod or hollow tubing has been disclosed for both conveying the collected ice cubes to the front of the storage bin and metering the cubes through the outlet opening of the bin. It is also known to use a screw or blade auger in combination with a wire auger, with the blade auger being disposed within an open-ended tube and positioned at the outlet opening of the bin to control the metering of the cubes through the opening. It is further known to provide separate augers for performing different functions, including circulating the collected cubes within the bin, conveying the cubes toward the front of the bin, and metering the cubes through the outlet opening.

There have been problems experienced with the performance of conventional ice dispensers. For example, the cubes tend to freeze together and form bridges or clusters of cubes above the auger and at the outlet opening of the storage bin. Moreover, the augers tend to move the cubes toward the outlet opening at a rate which exceeds the rate at which the cubes are being metered through the opening. This results in a bunching of the cubes as they accumulate at the front of the bin and prevents the cubes from being dispensed at a constant rate. Furthermore, when the dispensing operation is terminated by the user, the excess cubes gathered at the outlet opening of the bin tend to drop downwardly through the delivery chute and into the service area after the desired number of cubes have already been received within the receptacle and the auger motor has been turned off.

SUMMARY OF THE INVENTION

It is an object of the present invention to provide an improved ice dispenser for the automatic ice maker of a conventional household refrigerator.

It is another object of the invention to provide an improved ice dispenser which dispenses ice cubes at a constant rate and provides only the amount of ice desired by the user.

It is a further object of the invention to provide an improved ice dispenser which prevents both the bunching of ice cubes at the front of the ice storage bin and the blocking of the outlet opening of the bin by frozen clusters of ice cubes.

It is still another object of the invention to provide an improved ice dispenser which is simple in construction, reliable in operation and economical to manufacture.

These and other objects of the invention are realized by providing an ice dispenser wherein a longitudinal conveyor is mounted for rotation between the front and back walls of an ice storage bin positioned below the automatic ice maker in the freezer compartment of a household refrigerator. The rearward end of the conveyor is provided with a rotatable connection to a gear reduction assembly and electric motor. The forward end of the conveyor extends through the outlet opening of the bin and is rotatably journalled in a wall of an ice dam housing secured to the bin and enclosing the exterior side of the outlet opening. The conveyor includes spaced front and back helical sections separated by an intermediate straight section, with the pitch of the front helical section being wider than that of the rear helical section so that ice cubes collected in the bin are conveyed forwardly by the back helical section at a slower rate than that of the front helical section. A propeller is positioned forwardly of the front helical section at the outlet opening. The housing includes a ramp extending upwardly and outwardly from the bottom edge of the outlet opening. The bottom of the housing is open for dispensing ice metered through the outlet opening to a delivery chute of the service area in the freezer door of the refrigerator.

The combination of the front and back helical sections of different pitches, intermediate straight section, propeller and housing ramp collectively function to convey ice cubes collected in the storage bin to the front of the bin, and thereafter meter the cubes at a constant rate through the outlet opening during activation of the conveyor motor. The metering and dispensing of the cubes is precisely terminated upon deactivation of the motor. Clusters of ice cubes frozen together at the outlet opening are broken up by the propeller during operation of the conveyor.

Other objects, features and advantages of the invention shall become apparent from the following detailed description of a preferred embodiment thereof, when taken in conjunction with the drawings wherein like reference characters refer to corresponding parts in the several views.

DETAILED DESCRIPTION OF THE PREFERRED EMBODIMENT

Figure 1:
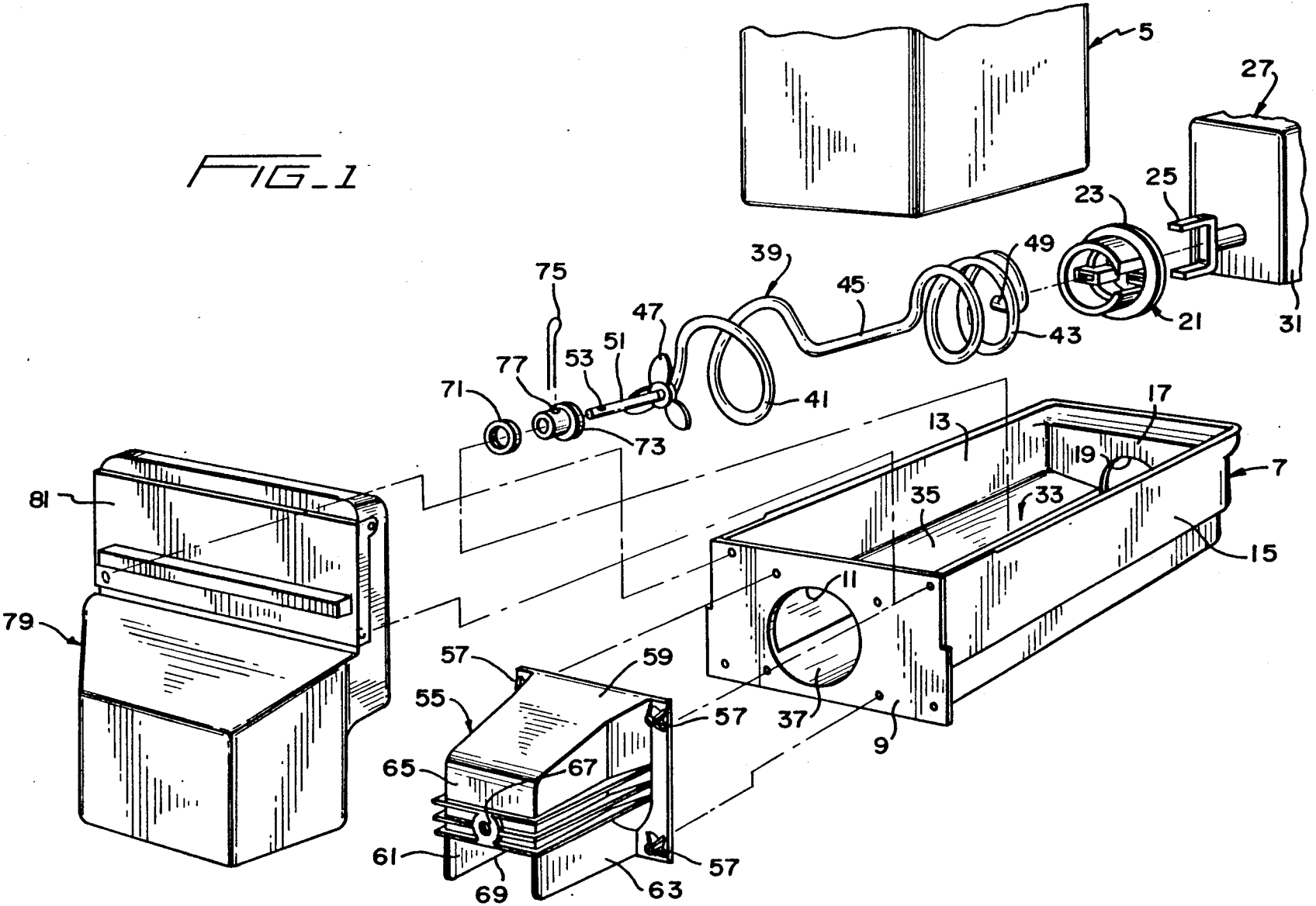
FIG. 1 is an exploded perspective view showing an ice dispenser according to a preferred embodiment of the invention.
Figure 2:
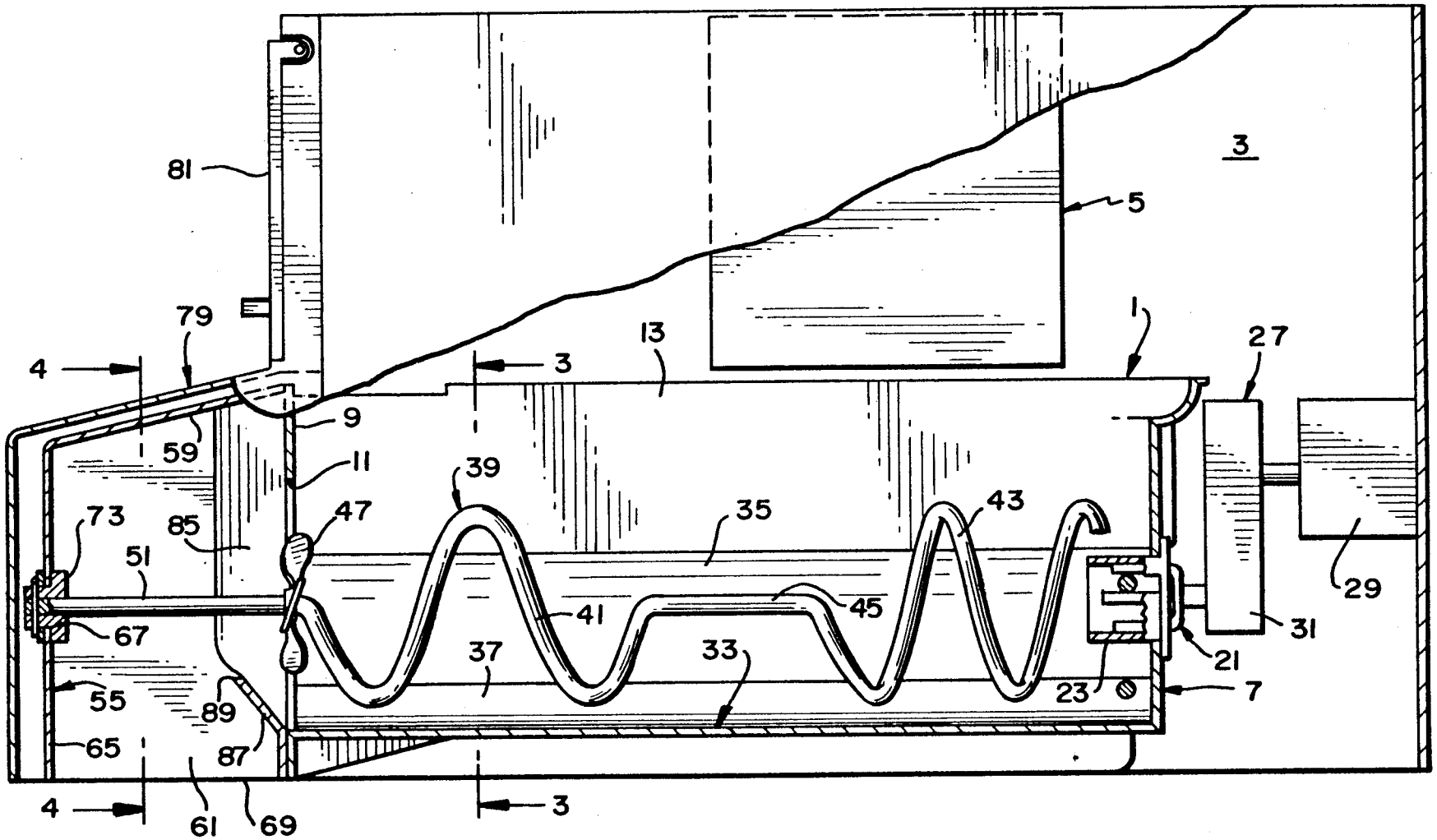
FIG. 2 is a side elevational view, partly in cross-section, depicting the ice dispenser within the freezer compartment of a refrigerator.

An ice dispenser 1, according to a preferred embodiment of the invention, shall now be described with initial reference to FIGS. 1 and 2. As particularly shown in FIG. 2, dispenser 1 is positioned within a freezer compartment 3 of a conventional household refrigerator, and is located below a conventional automatic ice maker 5 for collecting ice cubes manufactured by ice maker 5. It is understood that ice cubes manufactured by ice maker 5 may be of any type or configuration, including rectangular, square, cylindrical, crescent or the like.

Ice dispenser 1 includes a substantially rectangular-shaped storage bin 7 for collecting ice cubes manufactured by ice maker 5. Bin 7 is defined by a front wall 9 having a preferably circular outlet opening 11 formed therein, a pair of longitudinal side walls 13, 15, and a back wall 17 provided with a preferably circular aperture 19 formed therein for engagement by a rotatable connection assembly 21. The latter assembly may be of conventional configuration and include a cylindrical coupling 23 and a yoke 25. Assembly 21 is rotated by a conventional drive assembly 27 comprised of an electric motor 29 and a speed reduction unit 31. Bin 1 also includes a bottom wall 33 defined by a pair of inwardly and downwardly directed longitudinal side portions 35 and a central longitudinal curved trough 37. A longitudinal conveyor 39 is partially positioned within trough 37 and extends between front wall 9 and back wall 17 of bin 7. Conveyor 39 is preferably integrally formed from a length of solid rod or tubing that is configured to define a wire auger including a front helical section 41, a back helical section 43 and an intermediate straight section 45. A multi-bladed propeller 47 is rigidly mounted forwardly of front helical section 41. Conveyor 39 includes an inwardly directed rearward end 49 for detachable engagement with connection assembly 21 so that conveyor 39 may be rotated about its longitudinal axis upon operation of drive assembly 27. Conveyor 39 also includes a straight forward end 51 provided with a transverse hole 53 therethrough.

An ice dam housing 55 is secured to the exterior of front wall 9 by a plurality of appropriate mechanical fasteners 57. Housing 55 encloses outlet opening 11 of bin 7 and is defined by a top section 59, a pair of opposed side sections 61, 63, a front section 65 provided with an aperture 67 therethrough, and an open bottom 69. As seen in FIG. 2, forward end 51 of conveyor 39 is rotatably journalled through aperture 67 of front section 55 by a washer 71, a journal bearing 73 and a cotter pin 75 which is inserted through a pair of opposed holes 77 provided in bearing 73 and hole 53 of end 51.

Conveyor 39 is therefore supported for rotation about a longitudinal axis extending between front wall 9 and back wall 17 of storage bin 7 for conveying ice cubes collected therein toward outlet opening 11 during rotation of conveyor 39 by drive assembly 27. As also indicated, propeller 47 is positioned at opening 11 and is preferably of a diameter that is less than the diameter of opening 11 in order to define adequate spacings between the blades of propeller 47 and the peripheral edge of opening 11 to permit ice cubes to be metered through opening 11 by propeller 47 during rotation of conveyor 39.

An exterior enclosure assembly 79 is also secured to front wall 9 of storage bin 7 for enclosing ice dam housing 55. The upper portion of assembly 79 can be provided with a pivotal door 81 which may be opened by the user to permit direct access into storage bin 7 for manually retrieving ice cubes, if desired. Closure assembly 79 may be of any appropriate conventional structure.

Figure 3:
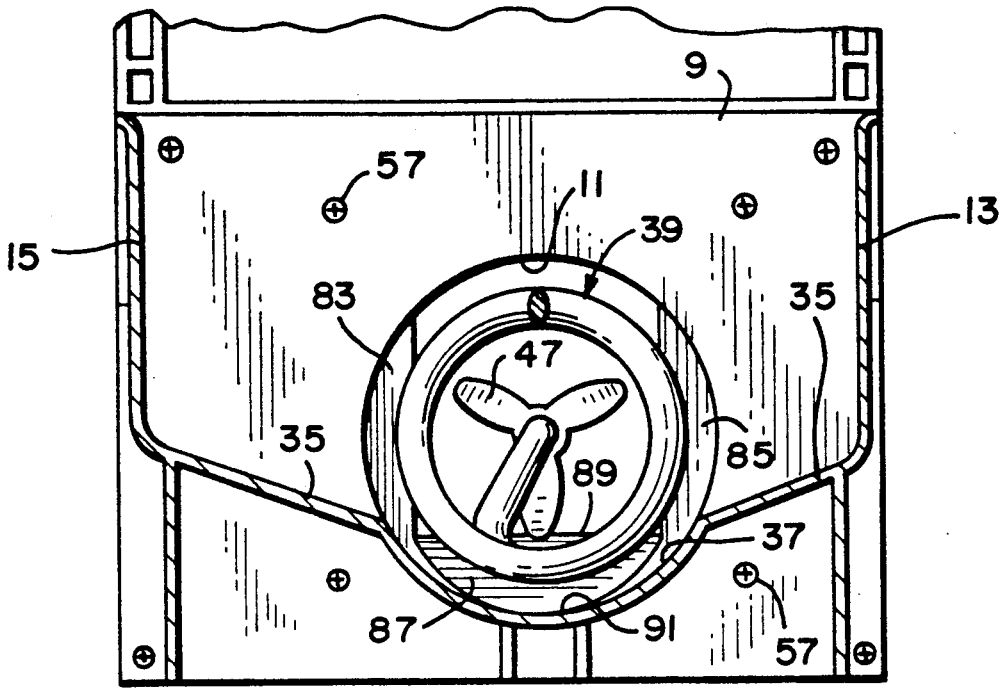
FIG. 3 is a cross-sectional view taken along the line 3—3 of FIG. 2.
Figure 4:
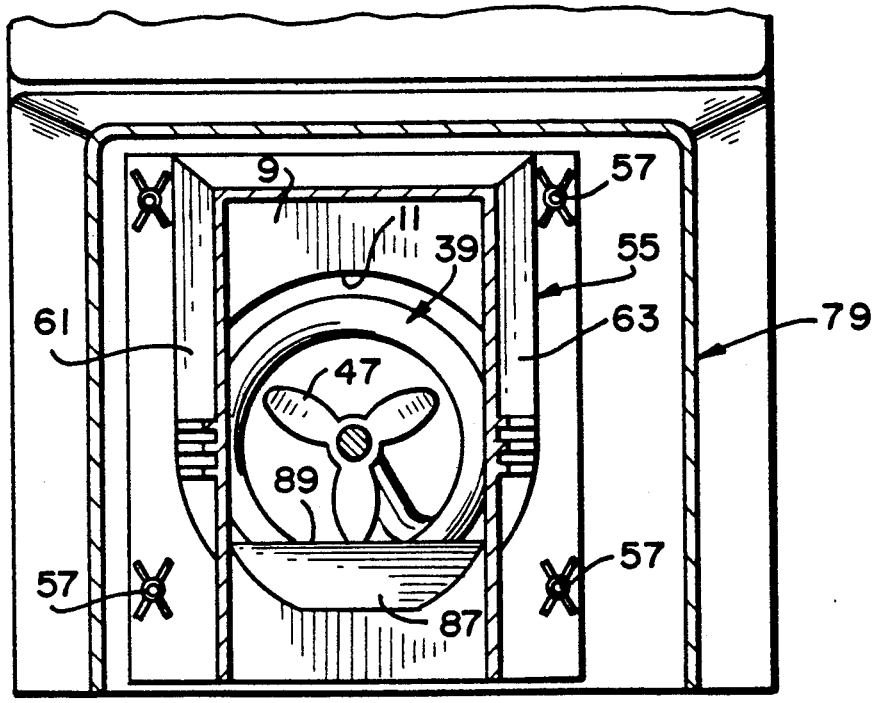
FIG. 4 is a cross-sectional view taken along the line 4—4 of FIG. 2.

With reference to FIGS. 3 and 4, the rearward portion of ice dam housing 55 is provided with a pair of vertical side walls 83, 85, which extend outwardly from adjacent edge portions of outlet opening 11 and converge toward front section 65. The lower portions of side walls 83, 85 terminate in a ramp 87 which extends upwardly and outwardly from the bottom edge of opening 11 and terminating in an upper horizontal edge 89 extending transversely across opening 11. The outer lower edges of side walls 83, 85 and lowermost outer edge of ramp 87 adjacent opening 11 are collectively configured to define a partial circular opening 91 having the same diameter as outlet opening 11 and is substantially coincident with the side and bottom edges thereof. Ice cubes metered through outlet opening 11 by conveyor 39 are partially retarded by the presence of ramp 87 and must proceed thereover in order to be dispensed downwardly through open bottom 69 of housing 55. The presence of converging side walls 83, 85 also serves to guide and control the metering of the cubes from opening 11 into housing 55.

Figure 5:
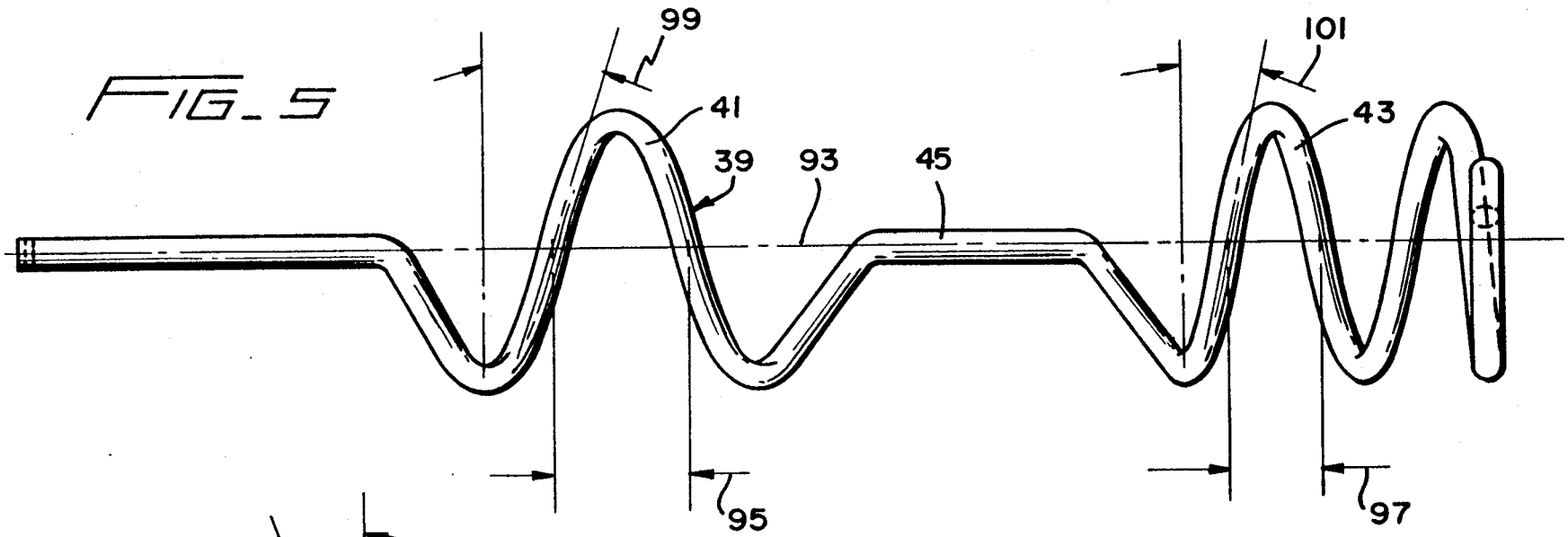
FIG. 5 is a front elevational view of the longitudinal conveyor with the propeller removed therefrom.

The details of conveyor 39 shall now be described with reference to FIG. 5. As seen therein, front helical section 41, intermediate straight section 45 and back helical section 43 are each preferably of substantially the same overall length and rotate about a common longitudinal axis of rotation 93 during rotation of conveyor 39. Both helical sections 41 and 43 are in the form of right hand spirals so that rotation of conveyor 39 about axis 93, when viewed from the right hand side of FIG. 5, is in a counterclockwise direction. As also apparent, front helical section 41 has a pitch 95 that is wider than a corresponding pitch 97 of back helical section 43. This results in a pitch angle 99 of front helical section 41 being greater than a corresponding pitch angle 101 of back helical section 43. Because of these differences in configuration between helical sections 41 and 43, it is apparent that helical section 43 will convey ice cubes forwardly at a slower rate than helical section 41. Straight section 45 provides no conveying action. By virtue of this arrangement, ice cubes within storage bin 7 are conveyed forwardly towards outlet opening 11 in a manner which avoids the problem of the cubes accumulating and bunching together at the forward end of bin 7. This results in a metering of cubes through outlet 11 by propeller 47 at a constant rate. Pitch angle 99 of front helical section 41 may preferably be about thirty degrees, with corresponding pitch angle 101 of back helical section 43 being preferably in the range of about ten to twenty degrees.

Figure 7:
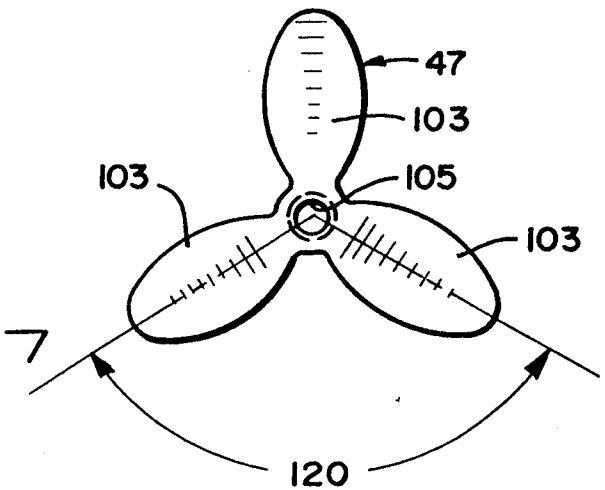
FIG. 7 is a front elevational view of the propeller.
Figure 6:
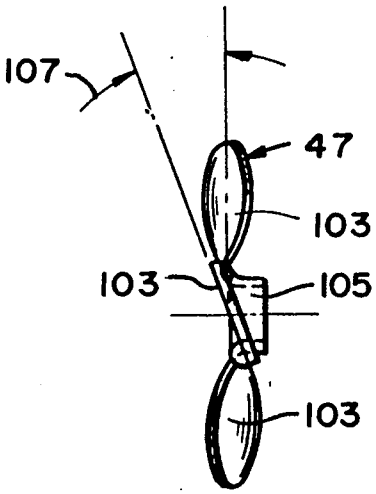
FIG. 6 is a side elevational view of the propeller.

The configuration of propeller 47 shall now be described with reference to FIGS. 6 and 7. As shown therein, propeller 47 is preferably formed of three blades 103 radiating outwardly from a central hub 105 which is axially and rigidly mounted on forward end 51 of conveyor 39. Blades 103 are circumferentially spaced one hundred and twenty degrees from each other, with each blade having a pitch angle 107 of about fifteen to thirty degrees, and preferably twenty degrees. As previously indicated, the diameter of propeller 47 is less than the diameter of outlet opening 1. In a preferred embodiment, outlet opening 11 has a diameter of 4.0 inches and propeller 47 has a diameter of 2.4 inches. With these latter dimensions, it is also preferred that ramp 87 extend outwardly from front wall 9 of bin 7 at an angle of about thirty-eight degrees, and vertically from the bottom edge of opening 11, a distance of about 0.75 inch.

The operation of ice dispenser 1 is initiated by the user engaging a conventional actuator with a receptacle in the service area of the freezer door. This activates motor 29 of drive assembly 27 which in turn rotates conveyor 39. This causes front helical section 41, back helical section 43, intermediate straight section 45 and propeller 47 to all simultaneously rotate about common axis of rotation 93. When this occurs, ice cubes collected in storage bin 7 are caused to move forwardly towards outlet opening 11. Because of the different pitch configurations between front and back helical sections 41 and 43, ice cubes toward the rear of bin 7 are conveyed forwardly at a slower rate, with no conveying action being imparted by straight section 45. Simultaneously, propeller 47 serves to both break up any frozen ice cube clusters in the vicinity of outlet opening 11 and meter cubes therethrough at a constant rate in accordance with the rate at which the cubes are conveyed forwardly towards the front of bin 7 by helical sections 41 and 43. The cubes exiting opening 11 are guided upwardly and outwardly by ramp 87, which initially retards their movement, and vertical side walls 83 and 85 of dam housing 55 for dispensing downwardly through open bottom 69 of housing 55. The cubes then fall through a conventional chute to the service area of the freezer door where the receptacle is located.

When the desired number of ice cubes have been received within the receptacle, the user releases the actuator, thereby terminating operation of drive assembly 27 and rotation of conveyor 39. Because of the presence of ramp 87 in housing 55, the metering and dispensing of cubes is also immediately terminated, thereby preventing excess cubes gathered around outlet opening 11 from being dispensed. This is realized because ramp 87 initially retards the movement of the cubes being dispensed through the lower portion of opening 11 and prevents excess cubes from dropping outwardly therefrom the moment conveyor 39 stops rotating. The invention therefore provides the conveying of ice cubes within bin 7 in a controlled manner, the metering of ice cubes through outlet opening 11 at a constant rate, and the regulated dispensing of only the desired number of cubes into the service area of the freezer door.

It is understood that the form of the invention herein shown and described is to be taken as a preferred embodiment of the same, and that various changes in composition, materials, size and configuration may be resorted to by one of ordinary skill in the art without departing from the spirit of the invention or scope of the subjoined claims.

We claim:

1. An ice dispenser for collecting and dispensing ice cubes manufactured by the automatic ice maker of a refrigerator comprising:

a) a storage bin including a front wall provided with an outlet opening and a back wall;

b) a longitudinal conveyor supported for rotation between the front and back walls of the bin for conveying ice cubes collected in the bin towards the outlet opening;

c) the conveyor including a front helical section, a back helical section, an intermediate straight section between the helical sections, and a propeller positioned forwardly of the front helical section at the outlet opening for metering the ice cubes through the outlet opening;

d) the pitch of the front helical section being wider than the pitch of the back helical section to permit the front helical section to convey the ice cubes at a faster rate than the back helical section; and e) means positioned on the exterior side of the front wall for retarding the movement of the ice cubes being metered through the outlet opening.

2. The ice dispenser of claim 1 wherein each helical section is in the configuration of a wire auger integrally formed with the straight section.

3. The ice dispenser of claim 2 wherein the helical sections and the straight section are each of substantially the same overall length.

4. The ice dispenser of claim 1 wherein the propeller includes three blades circumferentially spaced one hundred and twenty degrees from each other and extending radially outwardly from a common axis of rotation, with each blade having a pitch angle of from about fifteen to thirty degrees.

5. The ice dispenser of claim 4 wherein the pitch angle is about twenty degrees.

6. The ice dispenser of claim 4 wherein the outlet opening is of a circular configuration and having a diameter that exceeds the diameter of the propeller.

7. The ice dispenser of claim 1 wherein the helical sections, straight section and propeller all rotate about a common axis of rotation.

8. The ice dispenser of claim 1 further including a dam housing secured to the front wall of the bin and including a front section, the retarding means includes a ramp carried by the housing, the ramp extending upwardly and outwardly from the bottom of the outlet opening and defining a transverse edge extending thereacross, and the conveyor including a forward end extending through the outlet opening and rotatably journalled through the front section.

9. The ice dispenser of claim 8 wherein the dam housing further includes a top section, a pair of spaced side sections, an open bottom, and a pair of spaced vertical side walls extending upwardly from the ramp and converging towards the front section.

10. The ice dispenser of claim 1 wherein the conveyor includes a rearward end, the back wall includes a rotatable connection for rotation by an electric motor, and the rearward end of the conveyor being detachably engaged with the rotatable connection for rotating the conveyor during operation of the electric motor.

11. An ice conveyor of the type rotatably supported between the front and back walls of an ice storage bin for conveying ice cubes collected in the bin through an outlet opening in the front wall, which conveyor comprises:

a) front and back helical sections;

b) an intermediate straight section extending between the front and back helical sections;

c) the pitch of the front helical section being wider than the pitch of the back helical section to permit the front helical section to convey the ice cubes at a faster rate than the back helical section upon rotation of the conveyor; and d) a propeller positioned forwardly of the front helical section for disposition at the outlet opening to meter the ice cubes therethrough.

12. The ice conveyor of claim 11 wherein each helical section is in the configuration of a wire auger integrally formed with the straight section.

13. The ice conveyor of claim 12 wherein the helical sections and the straight section are each of substantially the same overall length.

14. The ice conveyor of claim 11 wherein the propeller includes three blades circumferentially spaced one hundred and twenty degrees from each other and extending radially outwardly from a common axis of rotation, with each blade having a pitch angle of from about fifteen to thirty degrees.

15. The ice dispenser of claim 14 wherein the pitch angle is about twenty degrees.

16. The ice dispenser of claim 11 wherein the helical sections, straight section and propeller all have a common axis of rotation.

* * * * *